US005964907A

United States Patent [19]

Farmer et al.

[11] Patent Number: 5,964,907

[45] Date of Patent: Oct. 12, 1999

[54] FUEL COMPOSITIONS CONTAINING ESTERAMINES

[75] Inventors: Robert F. Farmer, Barrington, Ill.; Ralph Franklin, Danbury, Conn.; Michael Kanakia, New Fairfield, Conn.; James F. Gadberry, Danbury, Conn.

[73] Assignee: Akzo Nobel N.V., Arnhem, Netherlands

[21] Appl. No.: 08/698,206

[22] Filed: Aug. 14, 1996

[51] Int. Cl.[6] ..... C10L 1/18; C10L 1/22

[52] U.S. Cl. ..... 44/391; 44/399

[58] Field of Search ..... 44/391, 399

[56] References Cited

U.S. PATENT DOCUMENTS

| | | | |
|---|---|---|---|
| 2,110,274 | 3/1938 | Mikeska et al. | 44/391 |
| 2,854,323 | 9/1958 | Shen et al. . | |
| 3,063,819 | 11/1962 | Watt et al. . | |
| 3,091,521 | 5/1963 | Liao | 44/399 |
| 3,117,931 | 1/1964 | Westlund et al. . | |
| 3,183,070 | 5/1965 | Udelhofen | 44/391 |
| 3,240,575 | 3/1966 | Miller et al. . | |
| 3,381,022 | 4/1968 | Le Suer . | |
| 3,658,707 | 4/1972 | Delafield et al. . | |
| 3,676,483 | 7/1972 | Hu . | |
| 3,807,973 | 4/1974 | Iwama et al. . | |
| 3,890,357 | 6/1975 | Rubin et al. . | |
| 3,920,729 | 11/1975 | Sagawa et al. | 44/399 |
| 3,957,854 | 5/1976 | Miller . | |
| 4,002,569 | 1/1977 | Rubin et al. . | |
| 4,204,481 | 5/1980 | Malec | 44/391 |
| 4,234,435 | 11/1980 | Meinhardt et al. . | |
| 4,622,047 | 11/1986 | Bernasconi et al. . | |
| 4,639,256 | 1/1987 | Axelrod et al. | 44/399 |
| 4,670,021 | 6/1987 | Nelson et al. | 44/399 |
| 4,810,263 | 3/1989 | Zimmerman et al. . | |
| 5,194,068 | 3/1993 | Mohr et al. | 44/399 |
| 5,298,038 | 3/1994 | Hashimoto et al. | 44/399 |
| 5,407,452 | 4/1995 | Cherpeck . | |
| 5,597,390 | 1/1997 | Loper | 44/391 |

FOREIGN PATENT DOCUMENTS

| | | |
|---|---|---|
| 650405 | 11/1964 | Belgium . |
| 0085803 | 8/1983 | European Pat. Off. . |
| 0117108 | 3/1984 | European Pat. Off. . |
| 0353713 | 2/1990 | European Pat. Off. . |
| 0464489 | 1/1992 | European Pat. Off. . |
| 1211144 | 3/1960 | France . |
| 2576032 | 7/1986 | France . |
| 2144199 | 3/1973 | Germany . |
| 2559480 | 1/1977 | Germany . |
| 57-170993 | 10/1982 | Japan . |
| 59-189192 | 10/1984 | Japan . |
| 60-137998 | 7/1985 | Japan . |
| 60-166389 | 8/1985 | Japan . |
| 61-281198 | 12/1986 | Japan . |
| 62-109893 | 5/1987 | Japan . |
| 899261 | 6/1962 | United Kingdom . |
| 1062605 | 3/1967 | United Kingdom . |
| 1410788 | 10/1975 | United Kingdom . |
| WO 9303120 | 2/1993 | WIPO . |
| WO 96/34177 | 10/1996 | WIPO . |

OTHER PUBLICATIONS

Owen, "Gasoline and Diesel Fuel Additives", *Critical Reports on Applied Chemistry*, vol. 25, pp. 23–33, date unavailable.

*Primary Examiner*—Jacqueline V. Howard
*Attorney, Agent, or Firm*—Dilworth & Barrese

[57] ABSTRACT

Engine deposits are reduced by adding an effective deposit-controlling amount of an esteramine to hydrocarbon fuel.

27 Claims, 2 Drawing Sheets

FUEL COMPOSITIONS CONTAINING ESTERAMINES

BACKGROUND

1. Technical Field

This disclosure relates to fuel compositions containing deposit control additives and methods for reducing deposits on the surface of engine components and within the combustion chamber. More specifically, this disclosure relates to fuel compositions containing a deposit-controlling amount of esteramines to inhibit and control engine deposits.

2. Background of Related Art

It is well known that automobile engines tend to form deposits within the combustion chamber and on the surface of engine components, such as carburetor ports, throttle bodies, fuel injectors, intake ports, intake valves, piston tops, and cylinder heads due to the evaporation, oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance.

It has now been discovered that certain esteramines are surprisingly useful for reducing engine deposits when employed as fuel additives in fuel compositions.

SUMMARY

Novel fuel compositions described herein comprise a major amount of fuel and an effective deposit-controlling amount of at least one esteramine of the general formula:

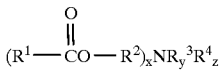

wherein $R^1$ is a $C_7$–$C_{21}$ hydrocarbon group, preferably a $C_7$–$C_{21}$ saturated or unsaturated alkyl group; x is 1, 2 or 3; y and z are individually selected from 0, 1 or 2; x+y+z=3; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups, —$(R^5O)_nH$ groups wherein $R^5$ and n are as defined above, and —$R^6$—N—$R^7R^8$ groups wherein $R^6$ is a $C_1$ to $C_6$ linear or branched alkylene group, and $R^7$ and $R^8$ can be the same or different and are individually selected from the group consisting of $R^3$, $R^4$ and

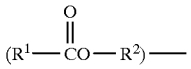

groups wherein $R^1$, $R^2$, $R^3$, and $R^4$ are as defined above.

In particularly useful embodiments, the esteramine is prepared by reacting a fatty acid with an alkanolamine, a polyalkanolamine, an alkoxylated amine or an alkoxylated polyamine. The esteramine can be a mono-, di-, tri- or tetra-ester and can be used alone or with other deposit-control additives. In a particularly useful embodiment, the presently disclosed esteramine additives are used in combination with a known polyetheramine additive. The resulting combination of additives surprisingly provides a synergistic effect with respect to reducing engine deposits.

Methods for reducing engine deposits in an internal combustion engine are also described. The methods comprise operating an engine with a fuel comprising an effective deposit-controlling amount of an esteramine; preferably an esteramine prepared by reacting a fatty acid with an alkanolamine or an alkoxylated amine.

BRIEF DESCRIPTIONS OF THE DRAWINGS

Various embodiments are described herein with reference to the drawings wherein:

FIG. 1 is a graph depicting measured engine intake valve deposits resulting from 80 hour operation of a four cycle engine using fuel containing various additive compositions, including presently described esteramine deposit control additive compositions; and FIG. 2 is a graph depicting measured engine deposits resulting from 80 hour operation of four cycle engine using fuel containing various additive compositions, including presently described esteramine deposit control additive compositions and showing the synergistic effects obtained when the presently described deposit control additives are combined with a known polyetheramine additive.

DETAILED DESCRIPTION OF PREFERRED EMBODIMENTS

Figure 1:
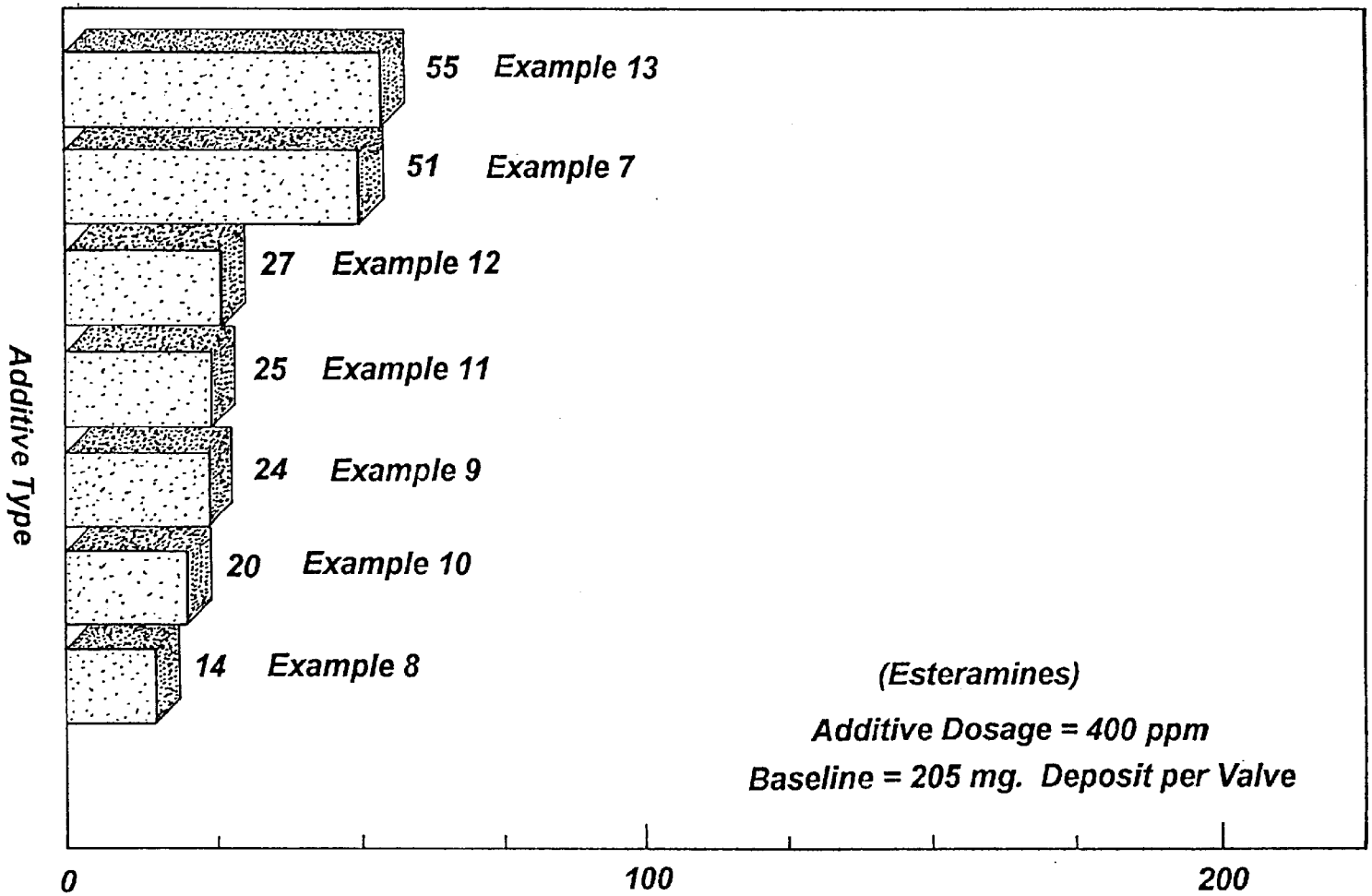

The fuel compositions described herein contain a major amount of gasoline and an effective deposit-controlling amount of at least one esteramine. The esteramine is of the general formula:

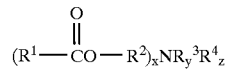

wherein $R^1$ is a $C_7$–$C_{21}$ hydrocarbon group, preferably a $C_7$–$C_{21}$ saturated or unsaturated alkyl group; x is 1, 2 or 3; y and z are individually selected from 0, 1 or 2; x+y+z=3; $R^2$ is selected from the group consisting of $C_1$–$C_6$ alkylene groups and, —$(R^5O)_nR^5$— groups wherein each $R^5$ can be the same or different and is individually selected from the group consisting of linear or branched $C_1$–$C_6$ alkylene group and n is 1 to 60, $R^3$ and $R^4$ can be the same or different and are individually selected from the group consisting of $C_1$–$C_6$ alkyl groups, —$(R^5O)_nH$ groups wherein $R^5$ and n are as defined above, and —$R^6$—N—$R^7R^8$ groups wherein $R^6$ is a $C_1$ to $C_6$ linear or branched alkylene group, and $R^7$ and $R^8$ can be the same or different and are individually selected from the group consisting of $R^3$, $R^4$ and

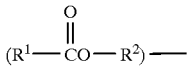

groups wherein $R^1$, $R^2$, $R^3$, and $R^4$ are as defined above.

In particularly useful embodiments, the esteramine is prepared by reacting a fatty acid with an alkanolamine, polyalkanolamine, an alkoxylated amine or alkoxylated polyamine. The fatty acid may be hydrogenated and is preferably a saturated fatty acid. Long chain fatty acids having 12 carbon atoms or more are particularly preferred for use in making the esteramine. Most preferred are long chain fatty acids having 16 to 18 carbon atoms, i.e., the tallow acids, including hydrogenated and partially hydrogenated tallow.

The fatty acid is reacted with an alkanolamine to provide an esteramine. Amines having one, two or three active sites can be employed to produce mono-, di-, or triesters, respectively. Thus, for example, triethanol amine can be reacted with a fatty acid to provide a triester. Methydiethanolamine will produce a diester when reacted with the fatty acid. Dimethylethanolamine will react with a fatty acid to generate a monoester. The conditions under which amines can be reacted with fatty acids to produce the present esteramines are known to those skilled in the art. Such reaction conditions are disclosed, for example, in PCT Publication No. WO91/01295, the disclosure of which is incorporated herein by this reference.

It is also possible to employ an alkoxylated amine or alkoxylated polyamine in preparing the present esteramine additives. Thus, for example, amines having one or more $(R^5O)_nH$ groups wherein $R^5$ and n are as mentioned above can be used as a starting material to produce the present esteramine deposit control additives. Such alkoxylated amines are available, for example, under the names Propomeen® and Ethorneen® from Akzo Nobel Chemicals Inc., Chicago, Ill. Preferably $R^5$ is selected from ethylene, propylene and mixtures thereof. The conditions under which alkoxylated amines are reacted with fatty acids to produce esteramines are also known and are described, for example, in U.S. Pat. No. 5,523,433, the disclosure of which is incorporated by reference.

It is also possible to synthesize suitable esteramines by reacting a fatty acid with a diamine having at least one alkanol group of the general formula:

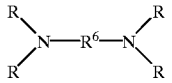

wherein $R^6$ is as mentioned above; R, which can be the same or different in each instance, is selected from H, $C_1$–$C_6$ saturated or unsaturated, substituted or unsubstituted, branched or unbranched alkyl and $C_1$–$C_6$ alkanol. Thus, for example, a tetraester can be prepared by reacting a fatty acid with a diamine of the formula:

$$(HOCH_2CH_2)_2NCH_2CH_2CH_2N(CH_2CH_2OH)_2.$$

Other starting materials for forming esteramines using diamines as a starting material will be apparent to those skilled in the art.

Esteramines suitable for use in connection with the fuel compositions and methods described in this disclosure should be soluble in the fuel and should not impart excessive water sensitivity to the fuel. Esteramines useful in the present invention are available from Akzo Nobel Chemicals Inc., Chicago, Ill.

The present fuel compositions contain an effective deposit-controlling amount of esteramine additives. The exact amount of additive that is effective in controlling deposits will depend on a variety of factors including the type of fuel employed, the type of engine and the presence of other fuel additives.

In general, the concentration of the esteramines in hydrocarbon fuel will range from about 50 to about 2500 parts per million (ppm) by weight, preferably from 75 to 1,000 ppm, more preferably from 200 to 500 ppm. When other deposit control additives are present, a lesser amount of the present additive may be used.

The present esteramine additives may also be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or high-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive will generally range from about 10 to about 70 weight percent, preferably to 50 weight percent, more preferably from 20 to 40 weight percent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, hydrocarbyl poly-(oxyalkylene) amines, or succinimides. Additionally, antioxidants, metal deactivators and demulsifiers may be present.

A fuel-soluble, nonvolatile carrier fluid or oil may also be used with the esteramine additives described herein. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, esters and polyesters.

The carriers fluids are typically employed in amounts ranging from about 100 to about 5000 ppm by weight of the hydrocarbon fuel, preferably from 400 to 3000 ppm of the fuel. Preferably, the ratio of carrier fluid to deposit control additive will range from about 0.5:1 to about 10:1, more preferably from 1:1 to 4:1, most preferably about 2:1.

When employed in a fuel concentrate, carrier fluids will generally be present in amounts ranging from about 20 to about 60 weight percent, preferably from 30 to 50 weight percent.

EXAMPLES

The following examples are presented to illustrate specific embodiments of the present compositions and methods. These examples should not be interpreted as limitations upon the scope of the invention.

In the following examples, references to Esteramines I–VII relate to the following compounds:

I. N,N-Dimethylethanolamine cocoate ester

II. N-Methyldiethanolamine di(hydrogenated tallowate) ester

III. Triethanolamine tritallowate ester

IV. N-Methyldiethanolamine ditallowate ester

V. N,N,N',N'-Tetra(2-hydroxyethyl)-1,3-propanediamine tetratallowate ester

VI. Alkoxylated methylamine ditallowate ester

VII. N,N-bis-(2-hydroxyethyl)-3-dimethylaminopropylamine ditallowate ester.

Examples 1–6

Esteramines I and II were used to formulate six fuel compositions which were tested to evaluate the tendency of the fuel compositions to form deposits on heated metal surfaces.

The compositions were evaluated using an induction system deposit (ISD) apparatus which is a bench-scale analytical laboratory tool that simulates two essential conditions that occur in the gasoline induction systems of spark-ignition engines: high temperature and thin film oxidation of atomized gasoline. In an ISD test, a fuel/air mixture is aspirated onto the outer surface of a internally heated metal deposit tube, in a flat spray pattern. This produces a roughly elliptical deposit on the cylindrical tube surface which can be weighed and visually evaluated. Test results from additized fuels can be interpreted as an indication of the relative effectiveness of the additives at reducing the deposit forming tendency of the fuel in a simulated induction system environment.

Additized samples for the ISD test were prepared by taking appropriate aliquots from 10 g/l stock solutions of the additives in the test fuel. 150 g of each sample was prepared and filtered through a 0.8 micro-meter membrane filter. Immediately after filtration, 150 ml of each test sample was tested on the ISD apparatus. Test data was recorded as deposit weight to nearest 0.1 mg. Tabulated data for additized fuel was presented as the percent of the "baseline" deposit produced by the unadditized test fuel.

$$\%\text{ of Baseline} = \frac{\text{mg deposit (additized fuel)}}{\text{mg deposit (unadditized fuel)}} \times 100$$

The test parameters used for all the tests are as follows:

| | |
|---|---|
| Test Temp. | 450° F. (232° C.) |
| Sample Size | 150 ml |
| Fuel Flow Rate | 2 ml/min |
| Air Flow Rate | 15 l/min |
| Cylinder Material | Aluminum |
| Test Fuel | Formulated by Phillips Petroleum Co. for port injector fouling tests |

The results which are presented in Table I, show that both esteramine products reduce the fuel deposit weight to between 40% and 45% of the level produced with unadditized fuel when they are used by themselves at 300 ppm by weight in the test fuel. When either product is used in combination with a solvent neutral oil, the deposit reduction is significantly improved (See Examples 3–6 in Table I.)

TABLE I

| | Ex. 1 | Ex. 2 | Ex. 3 | Ex. 4 | Ex. 5 | Ex. 6 | Ex. A |
|---|---|---|---|---|---|---|---|
| Esteramine I | 300* | — | 300 | — | — | — | — |
| Esteramine II | — | 300 | — | 300 | 300 | 150 | |
| Solvent Neutral Oil** | — | 300 | 500 | 500 | 500 | 500 | 500 |
| ISD Deposit (% of Baseline) | 44 | 42 | 27 | 11 | 15 | 28 | 58 |

*Additive Concentration is given as ppm by weight in test fuel.
**The Solvent Neutral Oil used was Kendex 600, Kendex/Amali Div. of Witco Corp.

Examples 7–13

Seven fuel compositions containing esteramine additives were formulated and tested to evaluate the additive's effectiveness at reducing deposits in an operating engine.

The fuel compositions identified in Table II were used to operate pre-cleaned Honda Genset Engines for 80 hours. The engines were then disassembled and any deposits on the underside of the inlet valves were carefully removed and weighed. Any deposits on the piston top and combustion chamber of these four-cycle engines were also carefully collected and weighed. A baseline was established by operating a Honda Genset Engine using a test fuel containing no additives. The results are reported in Table II and are graphically depicted in FIG. 1.

TABLE II

| Example | Additive | Combustion Chamber Deposit (g) | Intake Valve Deposit (mg) | Intake Valve Deposit (% of Baseline) |
|---|---|---|---|---|
| CONTROL | NONE | 1.2 | 205 | 100% |
| 7 | Esteramine I | 0.4 | 105 | 51% |
| 8 | Esteramine II | 1.3 | 29 | 14% |
| 9 | Esteramine III | 1.1 | 49 | 24% |
| 10 | Esteramine IV | 0.7 | 41 | 20% |
| 11 | Esteramine V | 1.4 | 51 | 25% |
| 12 | Esteramine VI | 1.2 | 55 | 27% |
| 13 | Esteramine VII | 1.4 | 113 | 55% |

In each case the concentration of the identified additive was 400 ppm and 500 ppm of a neutral solvent oil was also used.

As is evident from the values reported in Table II, the present esteramine additives reduced intake valve deposits by a minimum of about half to as much as 86% compared to the amount of deposit produced by non-additized fuel.

Examples 14 and 15

Fuel compositions were prepared by adding 400 ppm of the Esteramine II used in Example 2 to two different commercial fuels; namely Shell 87 octane regular unleaded gas and Exxon 87 octane regular unleaded gas. The chemical make-up of any additive package already in the commercial fuels was unknown. Each fuel composition was used to operate a Honda Genset Engine for 80 hours. Then, any deposits formed in the intake valve and combustion chamber were carefully removed and weighed as previously described. For comparison purposes the commercial fuels were tested without the addition of the present esteramine additives. The results are reported in Table III.

| Example No. | Composition | Intake Valve Deposit (mg) | Combustion Chamber Deposit (g) |
|---|---|---|---|
| Control | Shell Regular Gas (unleaded) | 0.0 | 1.9 |
| Example 14 | Shell Regular Gas Plus Esteramine I | 0.0 | 1.1 |
| Control | Exxon Regular Gas (unleaded) | 38 | 2.5 |
| Example 15 | Exxon Regular Gas Plus Esteramine II | 2.5 | 1.3 |

As the data in Table III show, the present esteramine additives significantly enhance any deposit control additives contained in the commercially available fuels tested.

Examples 16 and 17

The unexpected synergistic effects of the present esteramines when combined with a known polyetheramine additive were shown as follows: An 87 octane base fuel containing no additives was tested in the manner previously described to establish a baseline of deposits at the intake valve and combustion chamber of a four cycle engine. An esteramine deposit control additive in accordance with this disclosure (Esteramine II) was added to the base fuel to a concentration of 300 ppm and tested in the manner previously described to determine the amount of intake valve and combustion chamber deposits generated. A similar fuel composition containing the base fuel and 400 ppm of a polyetheramine additive that is commercially available under the name Techron from Chevron Corp. was also tested. Finally, a fuel composition containing the base fuel, 200 ppm of Esteramine II and 300 ppm polyetheramine was prepared and tested. The results are summarized in Table IV and graphically depicted in FIG. 2.

TABLE IV

| Example No. | Additive Composition | In the Valve Deposit (mg) | Combustion Chamber Deposit (g) |
|---|---|---|---|
| Control | None | 205 | 1.2 |
| 16 | Esteramine II | 24 | 1.3 |
| Control | Polyetheramine | 6.3 | 2.2 |
| 17 | Esteramine II plus Polyetheramine | 1.3 | 1.4 |

Figure 2:
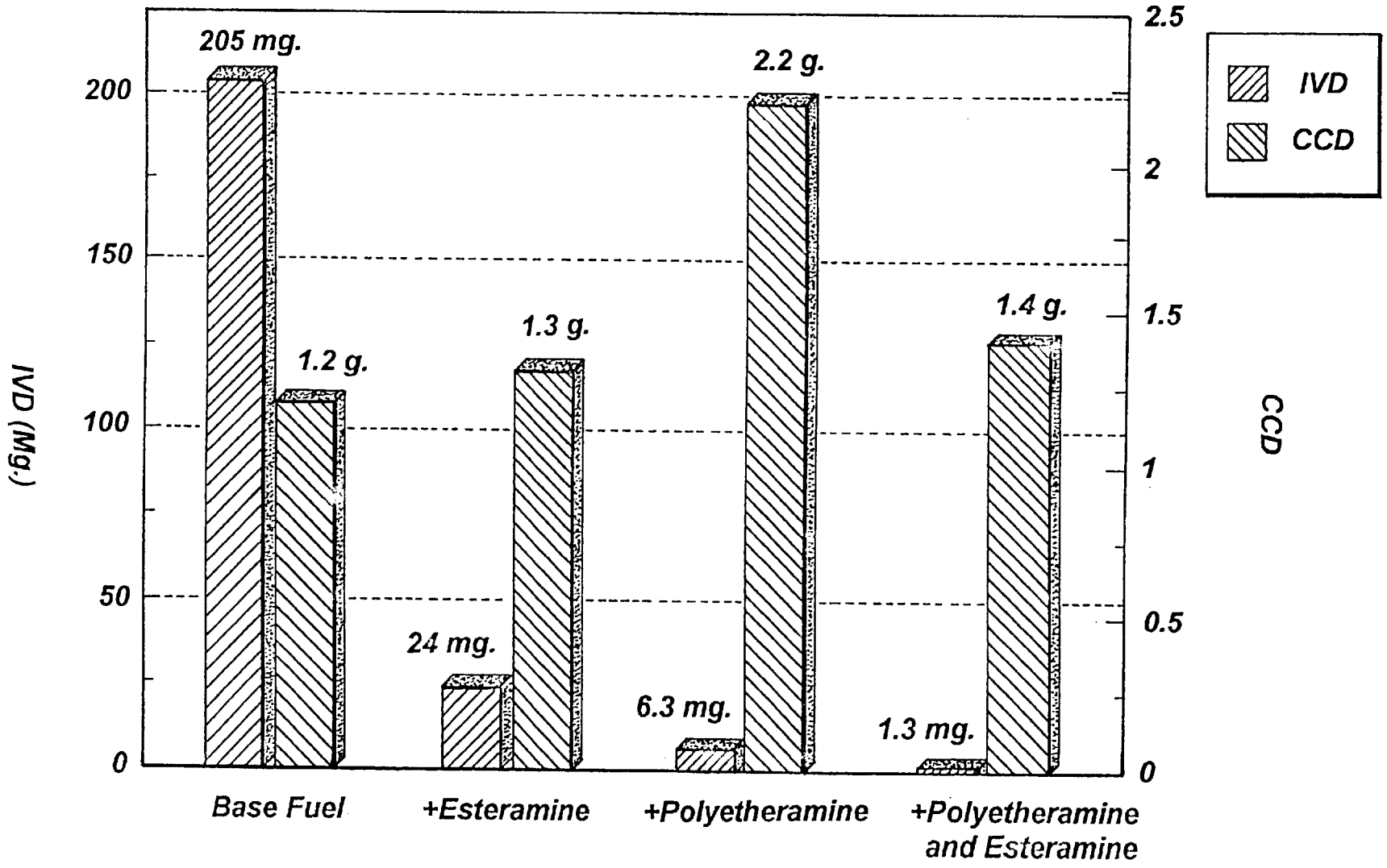

As the data in Table IV and FIG. 2 show, with respect to intake valve deposits the combined effects of the present esteramine additive and known polyether additive is greater than either of the additives individually.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. A method for reducing combustion chamber and intake valve deposits in a four cycle engine, the method comprising:

preparing a four cycle engine fuel composition by combining a major amount of gasoline with an effective intake valve and combustion chamber deposit-controlling amount of an additive, the additive consisting essentially of at least one esteramine of the formula:

$$(R^1-\overset{\overset{\displaystyle O}{\|}}{C}O-R^2)_xNR_y^3R_z^4$$

wherein $R^1$ is a hydrocarbon group derived from coco, tallow or hydrogenated tallow fatty acid; x is 2 or 3; y and z are individually selected from 0 or 1; x+y+z=3, $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups —$(R^5O)_nH$ groups wherein $R^5$ and n are as defined above, and —$R^6$—N—$R^7R^8$ groups wherein $R^6$ is a $C_1$ to $C_6$ linear or branched alkylene group, and $R^7$ and $R^8$ can be the same or different and are individually selected from the group consisting of $R^3$, $R^4$ and ($R^1$—COO—$R^2$)— groups wherein $R^1$, $R^2$, $R^3$ and $R^4$ are as defined above; and operating a four cycle engine using the fuel composition.

2. A method as in claim 1 wherein the esteramine is a diesteramine.

3. A method as in claim 1 wherein the esteramine is a triesteramine.

4. A method as in claim 1 wherein the esteramine is a tetraesterdiamine.

5. A method as in claim 1 wherein esteramine is added to the fuel at a concentration from about 50 to about 2500 ppm.

6. A method as in claim 1 wherein esteramine is added to the fuel at a concentration from about 200 to about 500 ppm.

7. A method as in claim 1 wherein the step of preparing a four cycle engine fuel further comprises adding a polyetheramine to the hydrocarbon fuel.

8. A method for reducing combustion chamber and intake valve deposits in a four cycle engine, comprising:

providing a hydrocarbon fuel for a four cycle engine; and adding to the hydrocarbon fuel an effective combustion chamber and intake valve deposit-controlling amount of an additive, the additive consisting essentially of at least one esteramine of the formula:

$$(R^1-\overset{\overset{\displaystyle O}{\|}}{C}O-R^2)_xNR_y^3R_z^4$$

wherein $R^1$ is a hydrocarbon group derived from coco, tallow or hydrogenated tallow fatty acid; x is 2 or 3; y and z are individually selected from 0 or 1; x+y+z=3, $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups —$(R^5O)_nH$ groups wherein $R^5$ and n are as defined above, and —$R^6$—N—$R^7R^8$ groups wherein $R^6$ is a $C_1$ to $C_6$ linear or branched alkylene group, and $R^7$ and $R^8$ can be the same or different and are individually selected from the group consisting of $R^3$, $R^4$ and ($R^1$—COO—$R^2$)— groups wherein $R^1$, $R^2$, $R^3$ and $R^4$ are as defined above.

9. A method as in claim 8 wherein the esteramine is a diesteramine.

10. A method as in claim 8 wherein the esteramine is a triesteramine.

11. A method as in claim 8 wherein the esteramine is a tetraesterdiamine.

12. A method as in claim 8 wherein esteramine is added to the fuel at a concentration from about 50 to about 2500 ppm.

13. A method as in claim 8 wherein esteramine is added to the fuel at a concentration from about 200 to about 500 ppm.

14. A method as in claim 9 further comprising the step of adding a polyetheramine to the hydrocarbon fuel.

15. A fuel composition for reducing combustion chamber and intake valve deposits comprising:

a major amount of a hydrocarbon fuel; and an effective combustion chamber and intake valve deposit-controlling amount of an additive, the additive consisting essentially of at least one esteramine of the formula:

$$(R^1-\overset{O}{\overset{\|}{C}}O-R^2)_xNR_y^3R_z^4$$

wherein $R^1$ is a straight chain $C_7$–$C_{21}$ hydrocarbon group; x is 2; y and z are individually selected from 0 or 1; x+y+z=3, $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups and —$(R^5O)_nH$ groups wherein $R^5$ and n are as defined above.

16. A fuel composition as in claim 15 wherein the $R^1$ in the formula of the esteramine is a $C_7$ to $C_{21}$ saturated or unsaturated alkyl group.

17. A fuel composition as in claim wherein the $R^1$ in the formula of the esteramine is derived from a $C_{16}$–$C_{18}$ saturated or unsaturated fatty acid.

18. A fuel composition for reducing combustion chamber and intake valve deposits comprising:

a major amount of a hydrocarbon fuel; and an effective combustion chamber and intake valve deposit-controlling amount of an additive, the additive consisting essentially of at least one diesteramine of the formula:

$$(R^1-\overset{O}{\overset{\|}{C}}O-R^2)_2NR^3$$

wherein $R^1$ is a $C_7$–$C_{21}$ hydrocarbon group; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ is selected from the group consisting of $C_1$–$C_6$ alkyl groups and —$(R^5O)_nH$ groups.

19. A fuel composition for reducing combustion chamber and intake valve deposits comprising:

a major amount of a hydrocarbon fuel; and an effective combustion chamber and intake valve deposit-controlling amount of at least one triesteramine of the formula:

$$(R^1-\overset{O}{\overset{\|}{C}}O-R^2)_3N$$

wherein $R^1$ is a $C_7$–$C_{21}$ hydrocarbon group; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60.

20. A fuel composition for reducing combustion chamber and intake valve deposits comprising:

a major amount of a hydrocarbon fuel; and an effective combustion chamber and intake valve deposit-controlling amount of at least one tetraesterdiamine of the formula:

$$((R^1-\overset{O}{\overset{\|}{C}}O-R^2)_2N)_2R^6$$

wherein $R^1$ is a $C_7$–$C_{21}$ hydrocarbon group; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60 and $R^6$ is a $C_1$–$C_6$ linear or branched alkylene group.

21. A fuel composition as in claim 15 wherein esteramine is present at a concentration from about 50 to about 2500 ppm.

22. A fuel composition as in claim 15 wherein esteramine is present at a concentration from about 200 to about 500 ppm.

23. A fuel composition as in claim 15 further comprising a polyetheramine.

24. A fuel composition as in claim 15 wherein the fuel composition is suitable for operating a four cycle engine.

25. A method as in claim 1 wherein the esteramine is selected from the group consisting of:

N-Methyldiethanolamine di(hydrogenated tallowate) ester,

Triethanolamine tritallowate ester,

Triethanolamine ditallowate ester,

N-Methyldiethanolamine ditallowate ester,

N,N,N',N'-Tetra(2-hydroxyethyl)- 1,3-propanediamine tetratallowate ester,

Alkoxylated methylamine ditallowate ester,

N',N-bis-(2-hydroxyethyl)-3-dimethylaminopropylamine ditallowate ester, and mixtures thereof.

26. A method as in claim 8 wherein the esteramine is selected from the group consisting of:

N-Methyldiethanolamine di(hydrogenated tallowate) ester,

Triethanolamine tritallowate ester,

Triethanolamine ditallowate ester,

N-Methyldiethanolamine ditallowate ester,

N,N,N',N'-Tetra(2-hydroxyethyl)-1,3-propanediamine tetratallowate ester,

Alkoxylated methylamine ditallowate ester,

N,N-bis-(2-hydroxyethyl)-3-dimethylaminopropylamine ditallowate ester, and mixtures thereof.

27. A fuel composition for reducing combustion chamber and intake valve deposits comprising:

a major amount of hydrocarbon fuel, and an effective combustion chamber and intake valve deposit-controlling amount of at least one esterdiamine of the formula:

$$(R^1-\overset{O}{\overset{\|}{C}}O-R^2)_2NR^6\overset{R^7}{\overset{|}{N}}R^2C(O)OR^1$$

wherein $R^1$ is a $C_7$–$C_{21}$ hydrocarbon group; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60 and $R^6$ is a $C_1$ to $C_6$ linear or branched alkylene group; and $R^7$ is selected from the group consisting of $C_{1-C6}$ alkyl groups, —$(R^5O)_nH$ groups where $R^5$ and n are as defined above and $(R^1C(O)OR^2)$— groups where $R^1$ and $R^2$ are as defined above.

* * * * *